US005126387A

United States Patent [19]

Hand

[11] Patent Number: 5,126,387

[45] Date of Patent: Jun. 30, 1992

[54] FLAME RETARDANT COMPOSITIONS AND METHOD OF USE

[75] Inventor: Geoffrey Hand, Halesowen, England

[73] Assignee: Albright & Wilson Limited, Oldbury, England

[21] Appl. No.: 663,403

[22] Filed: Mar. 1, 1991

[30] Foreign Application Priority Data

Mar. 1, 1990 [GB] United Kingdom ..... 9004633.5

[51] Int. Cl.[5] ..... C08J 5/24; C08K 5/49; C08L 85/02

[52] U.S. Cl. ..... 524/118; 524/117; 524/119; 524/131; 252/400.2; 252/400.22; 252/609

[58] Field of Search ..... 524/117, 118, 119, 131; 252/609, 400.2, 400.22

[56] References Cited

U.S. PATENT DOCUMENTS 3,969,437 7/1976 Shim ..... 428/276
4,748,705 6/1988 Johnson et al. ..... 428/265

*Primary Examiner*—Paul R. Michl
*Assistant Examiner*—U. K. Rajguru
*Attorney, Agent, or Firm*—Frishauf, Holtz, Goodman & Woodward

[57] ABSTRACT

A flame retardant composition comprises at least one cyclic phosphonate ester and at least one phosphono amide. The ester and the amide are present in a ratio by weight of 0.1 to 2:1. A co-curing agent (e.g. urea, ethylene urea or an amino-triazine) may be included. The composition may also contain a non-rewetting agent and/or a softening or conditioning agent. The composition is used for the flame retardant treatment of a fabric by first impregnating the fabric with an aqueous solution of the composition and then heating the impregnated fabric at at least 100° C. and under acid pH conditions.

22 Claims, No Drawings

FLAME RETARDANT COMPOSITIONS AND METHOD OF USE

This invention concerns flame retardant compositions and methods of rendering textile substrates flame retardant with them.

Cotton fabrics can be rendered flame retardant by incorporation therein of a wide variety of chemicals, providing durable or non durable flame retardance. Among such chemicals is 3-(dimethyl phosphono)-propionic acid methylol amide which is impregnated into the fabric and cured with heating under acid conditions usually with a coreactant such as a melamine formaldehyde condensate to provide a flame retarded cotton fabric with some degree of durability to washing. However, cotton polyester fabrics especially union fabrics are more difficult than cotton fabrics to render even semidurably flame retardant.

We have discovered flame retardant compositions and processes for applying them to fabrics of cellulosic and other materials to give fabrics of increased flame retardancy and durability thereof.

The present invention provides a flame retardant composition comprising:

(i) at least one cyclic phosphonate ester I of formula (A)

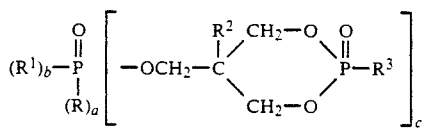

(A)

wherein a is 0, 1 or 2; b is 0, 1 or 2; c is 1, 2, or 3 and a+b+c is 3; R and $R^1$ are the same or dissimilar and are alkyl, alkoxy, aryl, aryloxy, alkaryl, alkaryloxy, aralkyl, aryloxyalkoxy, or aralkoxy wherein the alkyl portion of these groups may contain at least one hydroxyl but not halogen and the aryl portion may contain at least one chlorine, bromine or hydroxyl group; $R^2$ is alkyl, hydroxyalkyl, or aryl; and $R^3$ is lower alkyl (e.g. $C_1$–$C_4$), or hydroxyalkyl (e.g. $C_1$–$C_4$); or cyclic phosphonate ester of formula (B)

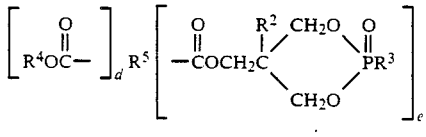

(B)

wherein d is 0, 1 or 2; e is 1, 2 or 3; d+e is 3; $R^2$ is as defined above; $R^3$ is defined above; $R^4$ is alkyl, aryl, alkaryl, aralkyl, or aryloxyalkyl, wherein the aryl portion may optionally contain at least one bromine, chlorine or hydroxyl; and $R^5$ is a tervalent hydrocarbyl radical which, if aromatic, may optionally contain at least one bromine, chlorine, alkyl or hydroxyl group; and (ii) at least one phosphono amide of formula

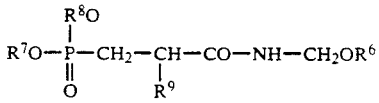

wherein $R^6$ represents a hydrogen atom or an organic radical, while each of $R^7$ and $R^8$ which may be the same or different represents an organic radical and $R^9$ represents a hydrogen or halogen atom or a alkyl group or group of formula $CH_2CONHCH_2OR^6$.

The present invention also provides a method of flame retarding a fabric which comprises impregnating a fabric having cellulosic and noncellulosic fibres with an aqueous medium comprising the flame retardant composition of the invention, and then subjecting the impregnated fabric to heat treatment at a temperature of at least 100° C. and under acid pH conditions.

The cyclic phosphonate ester I is described in U.S. Pat. Nos. 3,849,368 and 3,789,091, the disclosures of which are hereby incorporated by reference. It may be made as described in these patents by reaction of alkyl halogen free esters of phosphorus acids or carboxylic acids or sulphonic acids, with a bicyclic phosphite e.g. a 1-alkyl-4-phospha-3, 5, 8-trioxa bicyclo-[2,2,2]-octane. Alkyl, alkoxy or substituted alkyl groups for R and $R^1$–$R^5$ may contain 1–6 carbons, while aryl groups may be aromatic hydrocarbyl groups and may contain 6–19 carbons and aralkyl groups may be hydrocarbyl groups and may contain 7–19 carbon atoms. Examples of R and $R^1$ are $C_{1-8}$ alkyl, phenyl, halophenyl, hydroxyphenyl, tolyl, xylyl, benzyl, phenethyl, hydroxy ethyl, phenoxyethyl and dibromo phenoxy methyl. Examples of $R^4$ are $C_{1-4}$ alkyl, phenyl, halophenyl, hydroxyphenyl, hydroxyethyl, phenoxyethyl, dibromo phenoxy-ethyl, tolyl, xylyl, benzyl or phenethyl while examples of $R^5$ are $C_{1-6}$ alkane- or alkenetriyl groups and trivalent radicals derived form benzene, optionally substituted by one, two or three bromine or chlorine atoms, one or two $C_{1-4}$ alkyl, e.g. methyl groups or a hydroxy group, or from naphthalene. Preferred compounds among those of formula I are ones in which each of R and $R^1$ which may be the same or different represents a lower alkyl or lower alkoxy group e.g. of 1–6 carbons, especially 1–3 carbons, especially methyl, ethyl, methoxy and ethoxy, while each of $R^2$ and $R^3$ which may be the same or different, preferably represents an alkyl group e.g. of 1–6 carbons such as a methyl or ethyl group. Mixtures of the cyclic phosphonates may be used, such as ones with 95:5 to 5:95, e.g. 25:75 to 75:25, proportions of 2 phosphonates, especially a first phosphonate wherein each of a, b and c is 1, and a second phosphonate wherein a is 1, b is 0 and c is 2, each of the groups R, $R^2$ and $R^3$ independently in one phosphonate being otherwise the same as the corresponding group in the other phosphonate.

The most preferred mixtures are 40:60 to 60:40 mixtures of these two phosphonates wherein each of R, $R^2$ and $R^3$ represents a methyl or ethyl group and $R^1$ represents methoxy or ethoxy such as in Ex.1b of U.S. Pat. No. 3,849,368 especially wherein R and $R^3$ are methyl, $R^2$ is ethyl and $R^1$ methoxy; an example of such a mixture is the 50:50 w/w mixture (wherein R, $R^3$ are methyl, $R^1$ methoxy and $R^2$ ethyl) sold by Albright & Wilson Americas Inc under the Registered Trade Mark ANTIBLAZE 19 or by Albright & Wilson Ltd under the Registered Trade Mark AMGARD CU.

The phosphono amides are known per se (see e.g. GB Pat 1011572 and 1139380, the disclosures of which are herein incorporated by reference). In the phosphonoamide, the group $R^6$ preferably represents hydrogen, but may represent an organic radical e.g. of 1–10 carbon atoms such as an alkyl or alkenyl group, especially a 1–4 carbon atom alkyl group such as methyl, ethyl, propyl or butyl, or an allyl group. Each of $R^7$ and $R^8$, which are preferably the same, represents an organic group, e.g. of 1-13 carbon atoms, such as an optionally substituted alkyl group or alkenyl group, e.g. each of 1-6 carbons; an aryl group, e.g. of 6-13 carbon atoms; or a cycloaliphatic group, e.g. of 5-7 carbon atoms. Examples of such preferred groups are methyl or ethyl, which are preferred, propyl and butyl groups and mono-chloro or monobromo or chloro bromo derivatives of alkyl groups in general, especially derivatives of such preferred groups, and haloalkenyl groups of at most 4 carbon atoms and halo phenyl groups, e.g. chloro phenyl or bromophenyl. $R^9$ represents a hydrogen or halogen, e.g. chlorine, atom or alkyl group, e.g. of 1-6 carbons, such as methyl or ethyl or a group of formula $CH_2CONHCH_2OR^6$, where $R^6$ is as defined above; preferably $R^9$ represents hydrogen. A preferred phosphono amide is 3-(dimethyl phosphono)-propionic acid methylolamide of formula $(CH_3O)_2POCH_2CH_2CONHCH_2OH$.

The weight proportion of cyclic phosphonate to phosphonamide in the composition is usually 0.1-2:1, e.g. 0.2-1:1.

The flame retardant compositions preferably contain a cocuring agent for the phosphonoamide. The cocuring agents, which are usually heat curable are preferably formaldehyde condensates with a poly functional nitrogen containing compound with at least 2 NH groups, such as urea or amino triazines such as melamine, or cyclic compounds such as ethylene urea or acetylene diurea, and/or the nitrogen containing compounds themselves; the condensates may be optionally etherified. Preferably the cocuring agent is an optionally etherified methylol melamine with 3-6 methylol groups (or ethers thereof) or an optionally etherified methylol tetraacetylene diurea. Amounts of the cocuring agent are usually 5-30%, e.g. 10-25%, of the dry solids weight of the phosphonoamide.

The optionally etherified or partially alkylated methylolmelamine cocuring agent (hereafter also called the triazine) has a 1, 3, 5 triazine nucleus and three amino groups in the 2, 4, 6 positions usually carrying an average of 3-6, e.g. 3.5-6, and especially 4-5.5 hydroxymethyl groups, and these hydroxymethyl groups can be at least partially in the form of their alkyl ethers. The triazine usually has a cure time of at least 15 minutes, e.g. at least 40 minutes, at 70° C., which was determined in the following way:

To 20 g an aqueous solution of the triazine containing 80% reactive solids in a vessel was added 0.8 g of a 50% by weight aqueous solution of zinc nitrate hexahydrate with stirring until a clear solution was obtained and then the solution in the vessel was kept at 70° C. by means of a thermostated bath until such time (hereafter called the cure time) as curing had occurred to the extent that the cured material completely resisted any stirring motion with a metal spatula. The initial pH of the clear solution is usually 5.8-6.2. If needed, the pH of the aqueous solution of triazine or the clear solution can be adjusted by addition of nitric acid or sodium hydroxide so that the final pH of the clear solution is 5.8-6.2.

The cure time at 70° C. is usually 15 minutes to 10 hours, such as 40 minutes to 10 hours, e.g. 40 minutes to 6 hours, such as 40-200 or 40-140 and especially 40-75 minutes or 70-140 minutes. In the triazine at least some of the hydroxymethyl groups have preferably been etherified, e.g. to an extent of 10-100%, and especially 30-80% or 30-60% with alkyl groups, e.g. of 1-10 such as 1-5 carbons atoms, e.g. methyl, ethyl or butyl groups. The degree of etherification is usually higher with increasing numbers of hydroxymethyl groups per triazine nucleus. Thus with an average of 4.5-5.5 hydroxymethyl groups the degree of alkylation can be 30-60% and with an average of 5.5-6 groups the degree may be 60-90%. The triazine may contain an average of 3-6 or 3.5-6, preferably 4-5.5, in total of alkoxymethyl and hydroxymethyl groups per molecule; an average of 0.1-4, such as 0.5-2 or 1-3.5, and especially 1.5-3.5 hydroxymethyl groups per molecule; and an average of 1-5.9, such as 4-5.9 or 1.5-5, preferably 1.5-3.5, alkoxymethyl groups per molecule. The number of hydroxymethyl groups per triazine nucleus, and the degree to which they have been etherified are usually based on the number of moles of formaldehyde and alcohol respectively used in the process of their production, but may also be determined by physical or chemical methods of analysis. The etherification may be performed by reacting the hydroxymethyl melamine with the appropriate alkanol in the presence of an acid catalyst. The triazine compound is preferably in the form of the monomeric material but may also to a minor extent to be also in the form of low molecular weight self condensates of the monomer; preferably the compound is in the form of 55-100%, e.g. 70-90% monomer, and 45-0%, e.g. 30-10%, of the self condensate. Examples of commercially available optionally partially alkylated methylolmelamines are that sold as BT 370 by British Industrial Plastics with a cure time at 70° C. found to be 264 minutes and partially methylated hexamethylolmelamines such as Cibamin ML1000 GB sold by Ciba Geigy with a cure time at 70° C. found to be 290 minutes, but preferably the partially methylated methylolmelamine is such as is sold by British Industrial Plastics as BT 336, BT 338 or BT 309 with a cure time of 70° C. found to be 50, 25 and 23 minutes respectively, or as is sold as Lyofix CH by Ciba Geigy with a cure time at 70° C. found to be 108 minutes.

The compositions when ready for use at the start of the treatment are at a pH below 3, preferably 1.4-2.5. A strong mineral acid such as sulphuric or hydrochloric acid but preferably phosphoric acid is preferred to provide this pH value, but alternatively there may be used compounds which form the acid in the aqueous composition, such as salts with an acid reaction such as ammonium chloride or compounds hydrolyzing to form acid, such as inorganic or organic acid chlorides.

The flame retardant composition also may contain a dispersion of fluorocarbon polymer (capable of being heat cured at more than 160° C., e.g. 160° C.-200° C.). The fluorocarbon polymer is one which forms in the flame retardant composition a dispersion which is usually stable for at least a few days, e.g. at least 2 days. Thus fluoropolymers incompatible with the phosphonamide and cyclic phosphonate solution and forming precipitates on mixing therewith are avoided. Suitable aqueous dispersible polymers usually have perfluoro alkyl side chains e.g. in perfluoro-acyl, -sulphonyl or -sulphonamido groups, especially ones with 3-12 carbon atoms in the perfluoroalkyl group; carboxy groups may be present. The fluorocarbon polymers are preferably derived from acrylic or methacrylic esters of hydroxy compounds containing perfluoro alkyl groups but can be derived from vinyl esters, vinyl ethers, allyl esters or thiomethacrylates with perfluoro-alkyl side chains. Especially preferred polymers are ones containing (N-alkyl N-perfluoroalkylsulphon-amido) alkylene side chains e.g. 2-(N-propyl N-perfluorooctylsulphonamido)-ethylene side chains with an acrylate or methacrylate ester backbone. The polymers may be made only from monomers containing perfluoro alkyl groups. Alternatively these monomers may have been copolymerized with other copolymerizable monomers particularly ones fluorine free, e.g. ones containing one or especially two olefinic double bonds, e.g. halo butadienes, such as 2-chloro-1,3-butadiene. Olefinic monomer units containing carboxylic acid groups, e.g. acrylic, methacrylic or maleic acid groups may be present in the polymer. The fluoro polymers are usually sold in the form of aqueous dispersions e.g. for fluoropolymer soil repellent finishes for fabrics.

The polymer dispersion may be nonionic but is preferably cationic or especially anionic. The fluoropolymer dispersions may also contain small amounts of water miscible organic solvents, e.g. acetone, MIBK or ethylene glycol. A preferred fluoropolymer dispersion is that sold by 3M Company under the trademark SCOTCHGARD 270 or by Ciba Geigy under the trademark SCOTCHGARD FC451. This polymer is believed to be a copolymer of a 2-(N-alkyl N-perfluoro octylsulphonyl amido) ethyl acrylate and a comonomer, probably 2-chloro-1,3-butadiene. Another preferred fluoropolymer dispersion is that sold by Hoechst AG under the trademark NUVA FH or NUVA F.Fluoropolymer dispersions sold by Atochem SA under the trademark FORAPERLE especially FORAPERLE 145 and 344, or Texchem UK Ltd Manchester England under the trademark TEXFIN CPC may also be used. The weight percentage of fluoro polymer (solids) if present to phosphononamide is usually 0.1–5%, e.g. 0.2–2%. The flurocarbon polymers are however preferably substantially absent from the flame retardant composition and media of this invention.

The composition can also contain a non-rewetting agent, e.g. a volatile wetting agent such as an alcohol or an agent such as is sold by Warwick Chemicals under the trademark MYKON NRW. However if the substrate, which is to be flame retarded, has already been scoured or otherwise treated to aid penetration of liquids, then no such agent is required but one may be present if desired. Particularly when fluoropolymer is present the aqueous medium is usually free from extenders or cationic polymers such as cationic synthetic resin waxes, such as are sold under the trademark CEROL by Sandoz, and is also usually substantially free of di, tri or tetra valent metal salts, e.g. those of aluminium or zirconium. Some fluoropolymer dispersions are sold which contain also the extender or cationic polymer; these should preferably not be used. Fluoropolymer dispersions sold primarily to provide soil repellency, but not to provide soil and water repellency, are preferred as the latter tend to contain the cationic polymer and may be incompatible with the aqueous flame retardant composition.

If the fluoropolymer is to be present in the composition the fluoropolymer dispersion it is preferably added to the composition when it is otherwise ready for use for impregnation and the composition is preferably used for impregnation within a few days though, especially in the case of anionic fluoropolymer dispersions, the composition may be stable for at least 1 week, e.g. at least 1 month.

The aqueous composition may also contain other textile auxiliary agents of nature and in amount such that they are compatible with the other components of the composition, and are not significantly affected by the heat cure treatment, e.g. to cause discoloration or loss of effect. Examples of such agents are softening or conditioning agents, which may be cationic, anionic, nonionic, amphoteric or reactive, and usually contain at least 1 and often 2 alkyl chains of at least 10 carbon atoms.

Examples of cationic softening agents are fatty quaternary ammonium salts, amino esters and amino amides and quaternary N acyl N polyoxyalkylene polyamines. Examples of anionic softening agents are fatty acid salts, soaps, sulphonated fats and oils, fatty alkyl sulphates and fatty acid condensation products, sulphosuccinates and sulphosuccinamates. Examples of amphoteric agents are alkyl imidazolines and betaines and salts thereof e.g. methosulphate, acyl amido betaines, acyl polyamines, amine oxides, substituted amino acids and sulpho betaines. Examples of nonionic softening agents are poly alkylene glycol ethers and esters and other polyoxyalkylene condensation products, and paraffin wax or polyethylene wax, these latter two being used in aqueous dispersion or emulsion, with nonionic cationic or anionic but especially amphoteric dispersing agents. Examples of reactive softening agents are N-methylol derivatives of fatty acid amides e.g. N-methylol stearamide or N-methylol derivatives of fatty acid condensates with urea. Preferred softening agents are nonionic modified melamine formaldehyde condensation product softeners. The softening agent as such or as dispersion thereof may be used in amount of 0.01–5%, e.g. 0.5–3%, by weight of the total aqueous impregnation medium.

The presence of the softening agent can enable the heat cure process to produce a treated fabric having improved flame retardance and with other properties, e.g. strength, especially tear strength, and colour substantially the same as those of the untreated fabric; the strength may even be improved.

The substrates to which the composition is applied may be woven or non woven. They are cellulosic based substrates, e.g. textile fabrics, such as cotton, linen, jute, hessian or regenerated cellulosic materials, such as rayon or viscose, with other fibres coblendable or mixable therewith, e.g. polyester or nylon, acrylics, acetate, polypropylene, silk or wool. These blends or mixtures of fibres may contain at least 30%, such as 30–100% or 30–90%, but preferably at least 40%, such as 40–75%, and especially at least 50% of the cellulosic material, such as 50–90%, 50–80% or 70–90% thereof.

Preferred are fabrics from non blended mixtures of cellulosic material, e.g. cotton, and synthetic polymer, e.g. polyester or nylon. The fibres used to form at least part of the fabrics may if desired be of core sheath construction but are preferably not so. The fabrics are of union construction, for example with at least one of the weft and especially the warp being predominantly (e.g. 50–100%), especially essentially completely, of synthetic polymer fibres such as with a warp predominantly of polyester; polyester or nylon warp and cotton weft especially with embossed cotton designs are preferred. In the absence of the cyclic phosphonate application of flame to such union fabrics may tend to cause the polyester to shrink back and melt separately from the cotton and then burn, thus reducing the overall effectiveness of the flame retarded fabric when for example used in upholstery. The flame retardant compositions of the invention and the method of the invention enables one more uniformly to flame retard at least semidurably such union fabrics preferably embossed ones but especially ones with non uniform distribution of synthetic polymer and cellulosic material on a surface thereof hereinafter called "differential surface fabrics".

Particularly important differential surface fabrics are ones with a front side with a different (usually lower) proportion of the cellulosic material to synthetic material from that on the back side, as well usually as having a face or front side having significant areas of predominantly (e.g. 50–100%) fibres of synthetic polymer on the surface, as well usually as significant areas of predominantly (e.g. 50–100%) fibres of the cellulosic material. Examples of such differential surface fabrics are ones with a polyester warp and dyed cotton weft, especially with more than one differently coloured cotton weft, with the fabrics woven with front designs of such dyed cotton on a background of the polyester warp and a nondesigned back with a substantial cotton surface. Such differential surface fabrics may be used as upholstery fabrics.

Fabric weights can be 0.050–1.0 kg/m$^2$, e.g. 0.080–0.500 kg/m$^2$. Each of the components of the fabric may be plain or undyed or may be dyed especially with white or pastel shades. The fabric before impregnation is usually free of dirt, sizes, natural waxes and applied finishes though may contain an optical brightening agent.

The flame retardant composition usually contains, on a dry solids basis, 10–300 g/l, preferably 50–100 g/l, of the cyclic phosphonate; 50–600 g/l, preferably 100–250 g/l of the phosphonoamide; optionally but preferably 5–100 g/l, e.g. 15–60 g/l, of the cocuring agent; 10–50 g/l of the acid (sufficient to make the pH 1.5–3); optionally 5–50 g/l of softener, especially reactive softener; and 1–20 g/l, e.g. 0.1–5 g/l of non-rewetting agent.

The flame retardant composition in aqueous solution as such or after dilution with water if desired is at a pH less than 3 and is applied to the substrate by conventional procedures e.g. padding, soaking or spraying usually to a wet pick up of 50–150%, e.g. 60–110%. The total solids add on before drying and after squeezing off surplus liquid is usually 10–35%, e.g. 10–20% or 13–25% (based on the dry initial weight of the fabric).

After impregnation the substrate is then dried, e.g. at 60°–140° C., e.g. 90°–130° C., for 20–0.5 minutes, e.g. 10–0.5 minutes. The drying may be performed in any conventional drier, e.g. a forced air drier or stenter. The solids pick up after drying is usually 8–25%, such as 10–20% (based on the original weight of the fabric).

The dried substrate is then cured e.g. by heating at a temperature of at least 100° C., such as at least 130° C., e.g. 130°–200° C. such as 140°–170° C., e.g. for 10 to 0.5 minutes, the combination of longer times and higher temperature being avoided to decrease any tendency to discoloration. Thus preferred temperatures are 150°–170° C. for 5–2 minutes. The presence of any fluoropolymers in the impregnation medium and hence the fabric may increase the soil resistance of the fabric.

The curing which is usually continuous may be performed by radiant e.g. infra red heating or heating by injection of steam and/or hot air through the substrate, or by contact of the substrate with heated metal drums in a vertical stack, but preferably the curing is by heating from impact of hot air on the surface of the substrate, preferably on both surfaces to ensure uniformity of heating. Thus preferably the substrate is passed continuously on a stenter through a thermostated oven in which heated air flows are passed on to the top and bottom surfaces of the substrate. The stenter gives the most uniform curing with minimum scorching. In the case of the stenter oven, the cure temperature of the substrate is essentially the same as that of the heated air flow. Usually at the end of the curing the substrate is cooled rapidly by passing or drawing cool air through it. After curing the fabric is usually washed with an aqueous alkaline solution and washed with water.

The cured fabric after washing usually has a solids content of 6–25% such as 8–20%, and usually contains 0.5–4%, preferably 1–3%, 1.5–2.5% or 2–4% P.

The fabric has a reduced flammability compared to the untreated substrate and can pass the BS 5852 test with ignition sources 0 and 1. The reduced flammability finish is usually substantially durable to washing. The fabric usually has a handle not significantly changed from that of the untreated fabric.

The synergistic combination of the (i) cyclic phosphonate, and (ii) phosphonoamide can give treated fabrics with improved flammability and durability thereof not possessed by fabrics treated by (i) or (ii) alone. The invention is illustrated in the following Examples.

EXAMPLE 1

An aqueous impregnation liquid was prepared by mixing in the following order the ingredients below in the given amounts: 225 g/l of an 80% aqueous solution of 3-(dimethylphosphono)-propionic acid methylolamide, 40 g/l of an 80% aqueous solution of a partly etherified melamine formaldehyde condensate solution sold by British Industrial Plastics under the mark BT338, 25 g/l of phosphoric acid (88%), 15 g/l of a nonionic modified melamine formaldehyde condensate softener sold by Ciba Geigy under the trade mark TURPEX NPF, 1 g/l of a non-rewetting agent sold by Warwick Chemicals under the trade mark MYKON NRW and 70 g/l of cyclic phosphonates which were a 50:50 mixture of cyclic phosphonates sold under the Trade mark ANTIBAZE19 or AMGARD CU (as described above).

A 65:35 cotton polyester union fabric of weight 0.335 Kg/m$^2$ with polyester warp was impregnated with the aqueous liquid in a pad mangle and squeezed to give an impregnated fabric with a wet pick up of 95%. The impregnated fabric was dried in a forced air stenter for 2 min at 100° C. The dried fabric was then moved on a stenter slowly but continuously through a thermostated Benz dryer provided with heated air flows impinging on the fabric from top and bottom; the cure time was 3 minutes at 160° C.

The cured fabric was then washed off at a 20:1 Bucket:liquor ratio successively with 30 g/l aqueous sodium carbonate, 10 g/l aqueous sodium carbonate, hot water and cold water. The fabric was then dried and tested according to the test of BS5852 Part 1 (1979) with ignition sources 0 and 1 for flammability and after leach once in hard water at 40° C. according to BS 5651 Part 1 without final ironing. The fabric before and after the leach passed the test.

COMPARATIVE EXAMPLE

In a comparative Example, the process of Example 1 (above) was repeated with an otherwise identical bath from which the cyclic phosphonate was missing. The fabric before and after the leach failed the flammability test.

EXAMPLES 2 AND 3

Further examples of flame-retardant treatments on cotton/polyester upholstery fabrics using the method of Example 1, were carried out on a 55:45 cotton/polyester union fabric of weight 0.330 kg/m2.

The method of Example 1 was followed, apart from the addition of AMGARD CU:

225 g/3-(dimethylphosphono)-propionic acid methylolamide (80%)
40 g/l BT338
15 g/l TURPEX NPF
25 g/l Phosphoric acid (88%)
1 g/l MYKON NRW

Composition A

The above composition A was used as the basis for a series of 3 experiments which involved substitution of 50 g/l and 100 g/l of composition A with AMGARD CU to give compositions B and C.

The impregnation, drying, curing and wash off process were carried out as described in Example 1 prior to drying and testing.

TEST RESULTS

Samples treated with compositions B and C when tested according to the test of BS5852 Part 1 (1979(with ingition sources 0 and 1 for flammability passed the test both before and after the hard water leach as described in BS5651, without final ironing.

A sample treated with composition A failed the above flammability test.

I claim:

1. A flame retardant composition comprising:

(i) at least one cyclic phosphonate ester, said cyclic phosphonate ester having the formula (I):

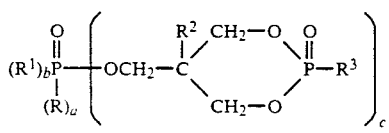

(I)

wherein:

a is a whole number of from 0 to 2;
b is a whole number of from 0 to 2;
c is a whole number of from 1 to 3;
(a+b+c) is 3;

R and $R^1$, which may be the same or different, are radicals selected from the group consisting of alkyl, alkoxy, aryl, aryloxy, alkaryl, alkaryloxy, aralkyl, aryloxyalkoxy and aralkoxy, the alkyl portion of said radicals optionally including at least one hydroxyl radical but no halogen radicals and the aryl portion of said radicals optionally including at least one radical selected from the group consisting of chlorine, bromine and hydroxyl;

$R^2$ is a radical selected from the group consisting of alkyl, hydroxyalkyl and aryl;

$R^3$ is a radical selected from the group consisting of lower alkyl and hydroxyalkyl; or said cyclic phosphonate ester having the formula (II)

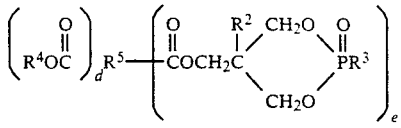

(II)

wherein:

d is a whole number of from 0 to 2;
e is a whole number of from 1 to 3; (d+e) is 3;
$R^2$ and $R^3$ are as defined above;

$R^4$ is a radical selected from the group consisting of alkyl, aryl, aralkyl and aryloxyalkyl, the aryl portion of said radicals optionally including at least one radical selected from the group consisting of bromine, chlorine and hydroxyl;

$R^5$ is a tervalent hydrocarbyl radical, which may be aliphatic or aromatic and if aromatic, said radical $R^5$ may optionally include a radical selected from the group consisting of bromine, chlorine, alkyl and hydroxyl;

(ii) at least one phosphono amide having the formula:

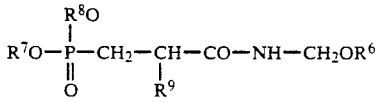

wherein:

$R^6$ is selected from the group consisting of hydrogen, alkyl radicals and alkenyl radicals;

$R^7$ and $R^8$ which may be the same or different, are organic radicals;

$R^9$ is selected from the group consisting of hydrogen, halogen, alkyl radicals and radicals having the formula $CH_2CONHCH_2OR^6$.

and (iii) a co-curing agent for said component (ii), said co-curing agent being a material selected from the group consisting of urea, amino triazines, ethylene urea, acetylene diurea, etherified formaldehyde condensates of acetylene diurea and mixtures of any two or more of said materials, said composition having, in an aqueous solution, a pH value of 3 or less.

2. The composition of claim 1, wherein R and $R^1$ are each independently a radical selected from the group consisting of alkyl radicals having from 1 to 6 carbon atoms and alkoxy radicals having from 1 to 6 carbon atoms.

3. The composition of claim 1, wherein $R^2$ and $R^3$ are each independently an alkyl radical having from 1 to 6 carbon atoms.

4. The composition of claim 1, wherein said component comprises a mixture of cyclic phosphonates, said mixture consisting of a first phosphonate of formula (I) wherein a=1, b=1, and c=1 and a second phosphonate of formula (I) wherein a=1, b=0 and c=2, each of said radicals R, $R^1$, $R^2$ and $R^3$ being the same in each said phosphonate.

5. The composition of claim 4, wherein said first and second phosphonates are present in said composition in a weight ratio of from 40:60 to 60:40 and wherein R, $R^2$ and $R^3$ are radicals selected from the group consisting of methyl and ethyl and $R^1$ is a radical selected from the group consisting of methoxy and ethoxy.

6. The composition of claim 4, wherein said first and second phosphonates are present in said composition in a weight ratio of 50:50 and wherein R and $R^3$ are methyl, $R^1$ is methoxy and $R^2$ is ethyl.

7. The composition of claim 1, wherein $R^6$ is a radical selected from the group consisting of hydrogen, alkenyl radicals and alkyl radicals having from 1 to 10 carbon atoms.

8. The composition of claim 1, wherein $R^7$ and $R^8$ are each independently a hydrocarbyl group having from 1 to 13 carbon atoms, which group may optionally be substituted by one or more halogen atoms.

9. The composition of claim 1, wherein $R^9$ is a radical selected from the group consisting of hydrogen, halogen, alkyl radicals having from 1 to 6 carbon atoms and $CH_2CONHCH_2OR^6$.

10. The composition of claim 1, wherein said component (ii) is $_2POCH_2CH_2CONHCH_2OH$.

11. The composition of claim 1, wherein the weight ratio of said component (i) to said component (ii) in said composition is from 0.1:1 to 2.1.

12. The composition of claim 1, wherein said co-curing agent (iii) has a cure time of greater than 15 minutes.

13. The composition of claim 1, wherein said composition also contains a fluoropolymer.

14. The composition of claim 13, wherein said fluoropolymer contains sulphonamido groups.

15. The composition of claim 1, wherein said composition also contains a material selected from the group consisting of non-rewetting agents, cationic agents, anionic agents, non-ionic agents, amphoteric agents, reactive softening agents and conditioning agents.

16. The composition of claim 1, wherein $R^7$ and $R^8$ are each independently an unsubstituted or substituted alkyl group having 1 to 6 carbons, an unsubstituted or substituted alkenyl group having 1 to 6 carbons, an aryl group having 6 to 13 carbons, or a cycloaliphatic group having 5 to 7 carbons.

17. The composition of claim 16, wherein R and $R^1$ are each independently a radical selected from the group consisting of an alkyl radical having 1 to 6 carbons and an alkoxy having 1 to 6 carbons; $R^2$ and $R^3$ are each independently an alkyl having 1 to 6 carbons or a hydroxyalkyl having 1 to 4 carbon atoms; $R^6$ is hydrogen, an alkyl radical having 1 to 10 carbon atoms or an alkenyl radical having 1 to 6 carbon atoms; $R^9$ is selected from the group consisting of hydrogen, halogen, an alkyl radical having 1 to 6 carbons and $CH_2CONHCH_2OR^6$.

18. The composition of claim 1, wherein R and $R^1$ are the same or different and are $C_{1-8}$ alkyl, phenyl, chlorophenyl, bromophenyl, hydrophenol, tolyl, xylyl, benzyl, phenethyl, hydroxyethyl, phenoxyethyl or dibromo phenoxy methyl; $R^2$ is methyl or ethyl; $R^3$ is methyl or ethyl; $R^4$ is $C_{1-4}$ alkyl, phenyl, bromophenyl, chlorophenyl, hydroxyphenyl, phenoxyethyl, dibromo phenoxyethyl, tolyl, xylyl or benzyl; and $R^5$ is a $C_{1-6}$ alkane.

19. The composition of claim 18, wherein the co-curing agent is in an amount of 5 to 30%, of the dry solids weight of the phosphonamide.

20. The composition of claim 11, wherein the co-curing agent is in an amount of 10 to 25%, of the dry solids weight of the phosphonamide.

21. The composition of claim 1, wherein the cyclic phosphonate ester is of the formula (I)

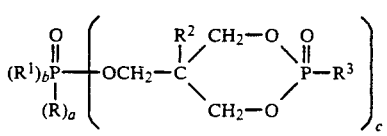

(I)

wherein:

a is 0 to 2;

b is 0 to 2;

c is 1 to 3;

a+b+c is 3;

R and $R^1$, which may be the same or different, are radicals selected from the group consisting of alkyl, alkoxy, aryl, aryloxy, alkaryl, alkaryloxy, aralkyl, aryloxyalkoxy and aralkoxy, the alkyl portion of the radicals optionally including at least one hydroxyl radical, but not a halogen radical and the aryl portion of the radicals optionally including at least one radical selected from the group consisting of chlorine, bromine and hydroxyl;

$R^2$ is a radical selected from the group consisting of alkyl, hydroxyalkyl and aryl;

$R^3$ is a radical selected from the group consisting of lower alkyl and hydroxyalkyl.

22. The composition of claim 1, wherein the cyclic phosphate ester is of the formula (II)

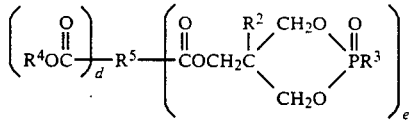

(II)

wherein d is 0 to 2;

e is 1 to 3;

(d+e) is 3;

$R^2$ is a radical selected from the group consisting of alkyl, hydroxyalkyl and aryl;

$R^3$ is a radical selected from the group consisting of lower alkyl and hydroxyalkyl;

$R^4$ is a radical selected from the group consisting of alkyl, aryl, aralkyl and aryloxyalkyl, the aryl portion of the radicals optionally including at least one radical selected from the group consisting of bromine, chlorine and hydroxyl;

$R^5$ is a tervalent hydrocarbyl radical, which may be aliphatic or aromatic and if aromatic said radical, $R^5$ may optionally include a radical selected from the group consisting of bromine, chlorine alkyl and hydroxyl.

* * * * *